US005950763A

United States Patent [19]

Ohta

[11] Patent Number: 5,950,763

[45] Date of Patent: Sep. 14, 1999

[54] OIL SUPPLYING DEVICE FOR AN ENGINE

[75] Inventor: Katsuya Ohta, Shizuoka-ken, Japan

[73] Assignee: Suzuki Motor Corporation, Japan

[21] Appl. No.: 08/966,128

[22] Filed: Nov. 7, 1997

[30] Foreign Application Priority Data

Nov. 29, 1996 [JP] Japan ..... 8-334841

[51] Int. Cl.[6] ..... F01M 11/02

[52] U.S. Cl. ..... 184/6.12; 184/11.2; 285/124.1; 123/196 R

[58] Field of Search ..... 184/6.5, 6.12, 184/11.2; 285/124.1, 397, 370; 123/196 R, 196 CP, 198 P

[56] References Cited

U.S. PATENT DOCUMENTS

| | | | |
|---|---|---|---|
| 3,831,951 | 8/1974 | Patel et al. | 285/124.1 |
| 4,616,610 | 10/1986 | Ishida | 184/6.5 |
| 4,834,219 | 5/1989 | Inagaki et al. | 184/6.5 |
| 5,666,915 | 9/1997 | Kawashima et al. | 123/196 R |

FOREIGN PATENT DOCUMENTS

| | | | |
|---|---|---|---|
| 61-277813 | 12/1986 | Japan | 123/196 R |

*Primary Examiner*—Tamara L. Graysay
*Assistant Examiner*—Chong H. Kim
*Attorney, Agent, or Firm*—Morrison Law Firm

[57] ABSTRACT

An engine oil supplying device wherein a lower case which supports a crank shaft is attached to a cylinder block of an engine. An oil pan is attached to the lower case and a chain case which covers a timing case is attached to one side surface of a crank shaft axis line of the engine On the inner side of the chain case, there is attached an oil pump which is driven by the crank shaft and which suctions oil from within the oil pan. One end of a main oil pathway opens toward an opening on a side surface on the crank shaft axis line of the cylinder block. The other end of the main oil pathway points towards the other side on the crank shaft axis line. Oil discharged from the oil pump is supplied to the main oil pathway. On a rotor plate of the oil pump which is attached to the chain case, there is provided a sealing member which seals the opening of the main oil pathway.

4 Claims, 10 Drawing Sheets

PRIOR
ART

PRIOR
ART

PRIOR
ART

PRIOR
ART

PRIOR
ART

OIL SUPPLYING DEVICE FOR AN ENGINE

BACKGROUND OF THE INVENTION

The present invention relates to an oil supplying device for an engine. In particular, the present invention relates to an oil supplying device for an engine which improves the sealing quality of an opening for a main oil pathway and which reduces seal failure. There is greater freedom in the placement position of an oil supply pathway. The pathway area for the oil supply pathway is ensured. The sealing quality of a secondary oil pathway is also improved.

An engine has an oil supplying device for lubricating sliding parts or cooling parts which reach high temperatures. The oil supplying device has an oil pump which is driven by a crank shaft of the engine. The oil pump suctions oil from an oil pool inside an oil pan and supplies the oil to a main oil pathway of a cylinder blocks. The oil in the main oil pathway is supplied to bearings of the crank shaft or to the inner surface of the cylinder. The oil lubricates as well as cools.

Referring to FIGS. 16–20, an oil supplying device for an engine of the prior art is shown. Referring to FIGS. 16–18, there is an engine 202, a cylinder block 204, a crank shaft 206, a lower case 208. Lower case 208 which supports crank shaft 206 on cylinder block 204 is attached to engine 202. An oil pan (not shown) is attached to lower case 208. A chain case 212 which covers a timing chain (not shown) is attached to cylinder block 204 and a side surface 210 along the crank shaft axis line A of lower case 208.

Referring to FIGS. 19 and 20, in oil supplying device 214 of engine 202, an oil pump 216 is attached inside chain case 212. Oil pump 216 is driven by crank shaft 206. A pump housing 220 is carried on a wall 218 of chain case 212. Oil pump 216 has an inner rotor and an outer rotor (not shown) which are capable of rotation and located internally within pump housing 220. A rotor plate 222 is attached so that it covers these rotors.

Oil pump 216 suctions and discharges oil within the oil pan. The discharged oil is supplied to main oil pathway 226 via an oil filter (not shown) and by secondary oil pathway 224 of cylinder block 204. Main oil pathway 226 opens at one end at opening 228 on side 210 in the crank shaft axis line A of cylinder block 204. The other end points towards the other side surface (not shown) of the crank shaft axis line A.

The oil in main oil pathway 226 is supplied by an oil supply pathway 234 to a block-side bearing surface 232 of block side bearing 230 of cylinder block 204. The oil is also supplied to the bearing surfaces of the crank shaft or a cam shaft or the like by an oil supply pathway not shown. The oil both lubricates and cools.

Oil supplying devices for an engine such as the one described above are disclosed in Japanese laid open patent publication numbers 61-185609, 3-51156, 1-102312.

In the oil supplying device disclosed in laid open publication number 61-185609, a crank shaft is supported by bearing caps which are each mounted on a plurality of journal walls on a cylinder block. The engine has a bridge member which links the plurality of bearing caps. A baffle plate is mounted on the underside of the bridge member as though to support the crank shaft and, the oil pooling.

In the oil supplying device disclosed in laid open publication number 3-51156, an oil-retaining/reinforcing plate is anchored to the lower end of a lower half frame which comprises the lower half of the crank case of an engine. An oil returning space is formed between the right and left walls of the lower half frame and both edges of the oil-retaining/reinforcing plate. An attachment boss piece for a suctioning pipe of an oil strainer is formed at this oil returning space.

In the oil supplying device disclosed in laid open publication number 1-102412, having a crank case side bearing, which supports the crank shaft, and the bearing cap as mating faces, the oil pathway which is supplied by a discharging area of the oil pump and an oil return pathway which returns to the suctioning area are connected. A relief valve is placed via the mating faces. An oil strainer is placed as a single body on the bearing cap via the suction pipes.

Referring to FIGS. 16–20, oil supplying device 214 has a main oil pathway 226 which opens at one end at opening 228 on one side surface 210 in the crank shaft axis line A of cylinder block 204. The other end points towards the other side surface of crank shaft axis line. Main oil pathway 226 is supplied by the oil discharged from oil pump 216. Referring to FIG. 16, opening 228 of main oil pathway 226 is closed off by screwing PT plug 236 into the opening.

Main oil pathway 228 has an inlet port 238 to a branch oil supply pathway 234 which connects to the block side bearing surface 232 of block side bearing 230 which supports crank shaft 206 of cylinder block 204.

Because of this, a part of inlet port 238 of branch oil supply pathway 234 which is formed on block side bearing 230 on side surface 210 in the crank shaft axis line A of cylinder block 204 can be blocked off by PT plug 236 which is screwed into opening 228 of main oil pathway 226.

PT plug 236 which is screwed into opening 228 of main oil pathway 226 can become inserted in deeper than is set due to tightening torque. Inlet port 238 of branch oil supply pathway 234 can be completely shut off, or else, due to over tightening, the area around opening 228 can become deformed and cracked. There is danger that the crack can result in failure or lowering of the sealing quality of main oil pathway 226.

The deformation around opening 228 of main oil pathway 226 due to PT plug 236 may also reduce the sealing quality between rotor plate 222 and secondary oil pathway 224, which is in neighboring contact with main oil pathway 226.

Oil pump 216 of oil supplying device 214 has a pump housing 220 on chain case 212. An inner rotor and an outer rotor (not shown) are located internally within pump housing 220 and are capable of rotation. A rotor plate 222 is attached so that it covers these rotors.

Referring to FIGS. 18 and 19, a guide pathway formation 240 is created on rotor plate 222. A strainer attachment flange 242 is formed on guide pathway formation 240. A guide pathway 246 is formed on guide pathway formation 240. Guide pathway 246 connects the oil pan to suction pathway 244 of oil pump 216. An oil strainer (not shown) is attached to strainer attachment flange 242.

But, because guide pathway formation 240 and strainer attachment flange 242 project towards the interior of rotor plate 222, a problem arises that chain case 212 must be made so that it does not interfere with block side bearing 230 on side 210 of crank shaft axis line A of cylinder block 204.

For this reason, chain case 212 projects a length L from side surface 210 in the crank shaft axis line A of cylinder block 4. The overall length of engine 202 becomes longer, and there is a disadvantage of increased weight.

Furthermore, referring to FIGS. 18 and 19, oil pump 216 of oil supplying device 214 has a rotor plate 222 attached to chain case 212. A relief pathway formation 248 is formed on rotor plate 222. Relief valve attachment part 250 is also formed on rotor plate 222. A relief pathway 254 which connects discharge pathway 252 of oil pump 216 to the oil pan is created in relief pathway formation 248. Relief valve 258 is attached to relief valve attachment hole 256 of relief valve attachment part 250.

Relief pathway formation 248 and relief valve attachment part 256 are placed so that it projects towards the interior of rotor plate 222. There is a problem in forming chain case 212 so that it does not interfere with block side bearing 230 on side 210 of crank shaft axis line A of cylinder block 204.

As a result, chain case 212 projects a distance L out from surface side 210 in the crank shaft axis line A of cylinder block 204. The overall length of engine 202 becomes longer, and there is a disadvantage of increased weight.

OBJECTS AND SUMMARY OF THE INVENTION

An object of the present invention is to provide an oil supplying device for an engine which overcomes the drawbacks of the prior art.

Another object is to improve the manner of sealing an engine main oil pathway and suchwise as to reduce incidence of seal failure.

A further object is to optimize a locating of the main oil pathway in an engine.

Another object is to provide an oil supplying device which allows shortening of overall engine length and lessening of engine weight.

In accordance with the invention the oil supplying device for an engine is one wherein a lower case which supports a crank shaft is attached to a cylinder block of an engine, an oil pan is attached to the lower case, a chain case which covers a timing chain is attached to one side surface of a crank shaft axis line of the engine. On the inner side of the chain case, there is attached an oil pump which is driven by the crank shaft and which suctions oil from within the oil pan. One end of a main oil pathway has an opening on a side surface on the crank shaft axis line of the cylinder block, the other end of the main oil pathway pointing towards the other side on the crank shaft axis line. Oil discharged from the oil pump is supplied to the main oil pathway. On a rotor plate of the oil pump which is attached to the chain case, there is a sealing means which seals the opening of the main oil pathway. In contrast to the PT plug of the prior art, the inlet port for the oil supplying pathway on the block side bearing of the cylinder block is not plugged. The opening of the main oil pathway can be stoppered without the area around the area around the opening of the main oil pathway becoming deformed.

According to another embodiment, on the case side bearing of the lower case which supports the crank shaft, there is a guide pathway which connects the oil pan to a suction pathway of the oil pump. On the oil pan side of the guide pathway with the oil pan, there is a strainer attachment part which attaches an oil strainer. The guide pathway which brings oil in the oil pan to the oil pump and the strainer attachment part which attaches the oil strainer can be created using the case side bearing of the lower case. In contrast to the prior art, no guide pathway formation or strainer attachment flange projects out from the rotor plate. The length that the chain plate to which the rotor plate is attached out in the crank shaft axis line can be shortened.

In a further form of the invention, on case side bearings of the lower case which supports the crank shaft, there is provided a relief pathway which connects a discharge pathway of the oil pump to the oil pan. Along the relief pathway of the case side bearings, a relief valve attachment hole is provided for attaching a relief valve. As a result, a relief pathway which relieves oil discharged from the oil pump and a relief valve attachment hole where the relief valve is attached can be created using the case side bearing of the lower case.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
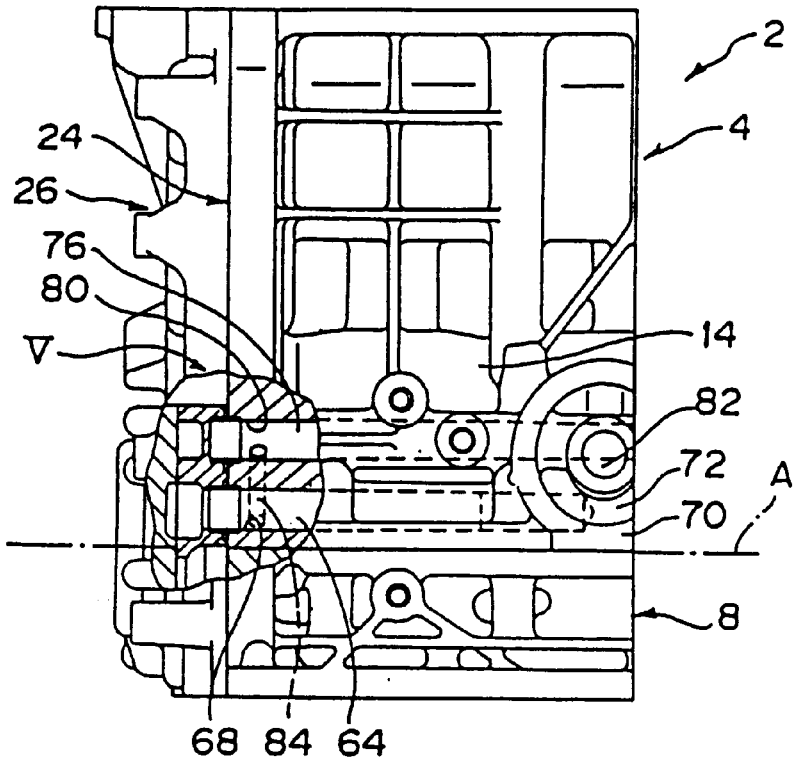
FIG. 1 is a partial side view with a portion broken away of an engine incorporating a first embodiment of the present invention.

Embodiments of the invention are explained. Referring to the FIGS. 1–6 the first embodiment, FIG. 6, is shown an engine 2, a cylinder block 4, a crank shaft 6, a lower case 8, and an oil pan 10. In engine 2, lower case 8 is attached to cylinder block 4 and supports crank shaft 6. Oil pan 10 is attached to lower case 8. A cylinder head which is not shown is attached to cylinder block 4. Engine 2 supports a cam shaft (not shown).

Figure 2:
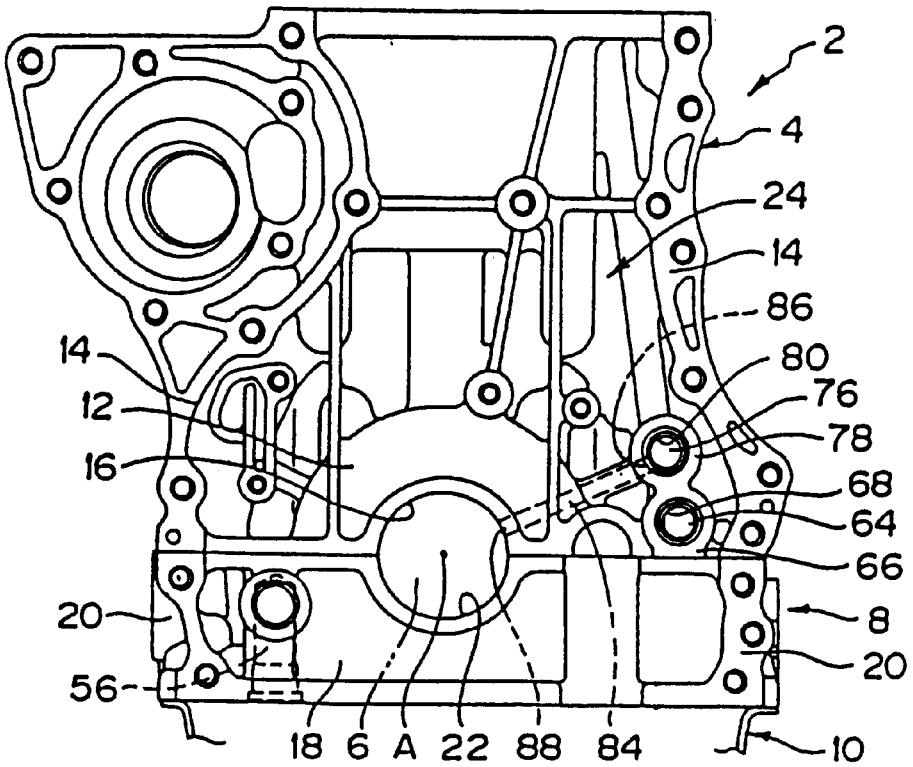
FIG. 2 is a front view of the FIG. 1 engine.

Referring to FIGS. 1 and 2, a plurality of block side bearings 12 are placed in parallel in a direction which intersects crank shaft axis line A. Each of the ends of the plurality of block side bearings 12 which is in the direction which intersects the crank shaft axis line A is connected to block wall 14. Each of the block side bearings 12 have a block side bearing surface 16.

In lower case 8, a plurality of case side bearings 18 work together with block side bearings 12 to support crank shaft 6. Case side bearings 18 are placed in parallel in a direction which intersects crank shaft axis line A. Each of the ends of the plurality of case side bearings 18 which is in the direction which intersects crank shaft axis line A are connected by a case linking member 20. On each case side bearing 18, there is a case side bearing surface 22.

Crank shaft 6 is supported by block side bearing surface 16 of block side bearing 12 of cylinder block 4 and by case side bearing surface 22 of case side bearing 18 of lower case 8.

Figure 3:
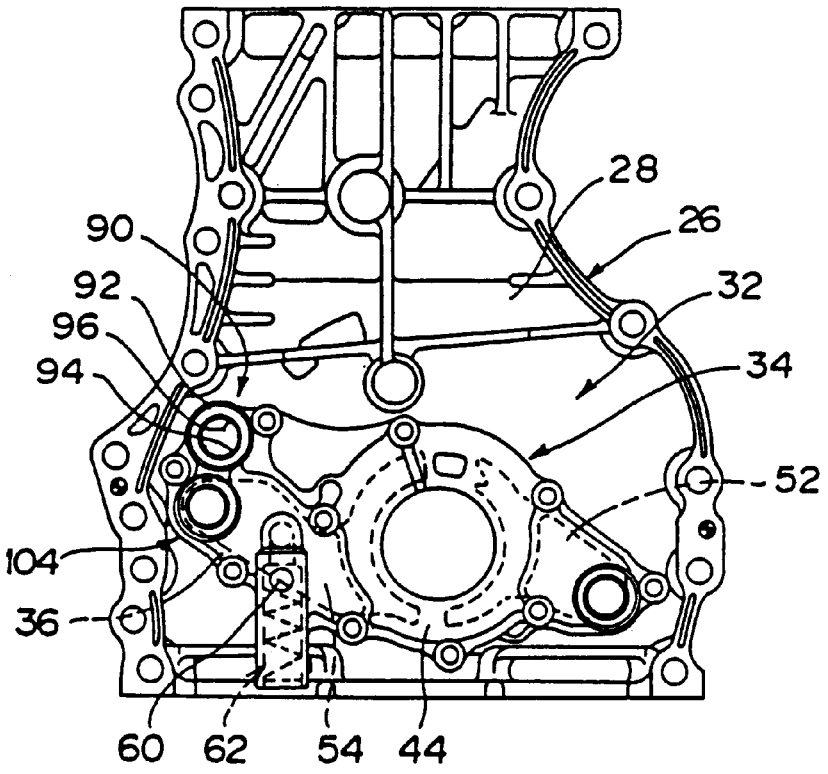
FIG. 3 is a rear view of a chain case of the FIG. 1 engine.
Figure 4:
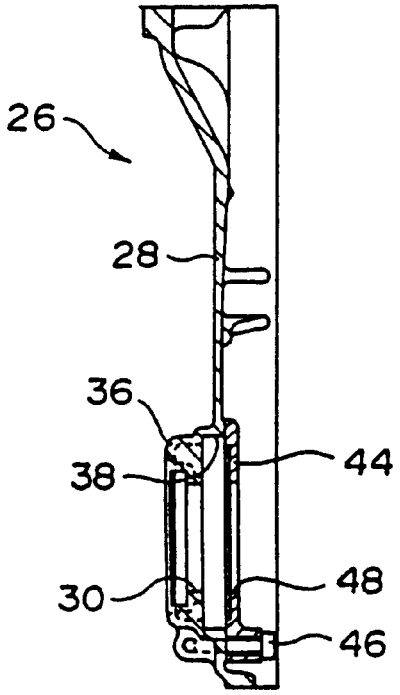
FIG. 4 is a cross-section of the chain case.

As seen from FIGS. 3 and 4, a chain case 26 is attached to engine 2 on one side surface 24 in the crank shaft axis line A direction of lower case 8 and cylinder block 4. Chain case 26 covers a timing chain (not shown) which links crank shaft 6 and a cam shaft (not shown). On a wall 28 which covers side surface 24 in the crank shaft axis line A direction of lower case 8 and cylinder block 4, chain case 26 has an insertion hole 30 where crank shaft 6 is inserted.

Engine 2 has an oil supplying device 32. Oil supplying device 32 has an oil pump 34. Oil pump 34 is on the interior of wall 28 of chain case 26 and is driven by crank shaft 6.

In oil pump 34, the area around insertion hole 30 on wall 28 of chain case 26 is projected outward and defines a pump housing 36. A rotor storage convex area 38 is formed in pump housing 36. Rotor storage convex area 38 receives an inner rotor 40 which is rotated by crank shaft 6 and, an outer rotor 42 which surrounds inner rotor 40 and which rotates together with inner rotor 40. A rotor plate 44 which covers inner rotor 40 and outer rotor 42 is attached by a plate attachment bolt 46. Rotor plate 44 has a crank shaft hole 48 where crank shaft 6 is inserted. In oil pump 34, a suction pathway 52 and a discharge pathway 54 which are connected to pump interior 50 between the gear of inner rotor 40 and outer rotor 40 are placed between pump housing 36 of chain case 26 and rotor plate 44. Suction pathway 52 is connected to oil pan 10 by way of guide pathway 56 and through an oil strainer 58. Discharge pathway 54 is connected to oil pan 10 by way of a relief pathway 60 and through a relief valve 62.

Oil pump 34 pumps oil from a pool thereof in oil pan 10 to suction pathway 52 by way of guide pathway 56 and through oil strainer 58. The oil in suction pathway 52 is suctioned and compressed in pump interior 50. The oil is discharged to discharge pathway 54. The oil discharged in discharge pathway 54 is adjusted to the desired pressure by relief valve 62. Excess oil is returned to oil pan 10 by relief pathway 60.

A secondary oil pathway 64 which communicates with discharge pathway 54 is on cylinder block 4. One end of secondary pathway 64 opens at an opening 68 of opening boss 66 for the secondary pathway on side surface 24 in the crank shaft axis line A direction of cylinder block 4. The other end is pointed towards the other side (not shown) of the crank shaft axis line A. Secondary oil pathway 64 communicates with an inlet pathway 72 of a filter attachment part 70 on block wall 14 on the other end. Inlet pathway 72 communicates with oil filter 74 which is attached to filter attachment part 70.

A main oil pathway 76 is provided in cylinder block 4. Main oil pathway 76 is in neighboring contact with secondary pathway 64. One end of main oil pathway 76 opens at 80 of opening boss 78 for the main oil pathway on side surface 24 in the crank shaft axis line A direction of cylinder block 4. The other end points towards the other side of the crank shaft axis line A. At one point, main oil pathway 76 communicates with exit pathway 82 of oil filter 74.

On each of the block side bearings 12 of cylinder block 4, there is provided an oil supplying pathway 84. One end of oil supplying pathway 84 opens towards inlet port 86 of main oil pathway 76. The other end opens towards exit hole 88 on block side bearing 16.

Figure 5:
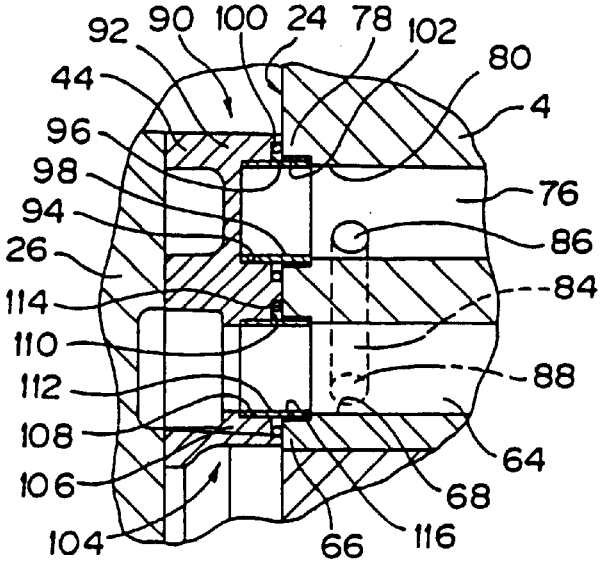
FIG. 5 is an enlarged cross-sectional showing of the engine portion designated by the arrow V in FIG. 1.
Figure 6:
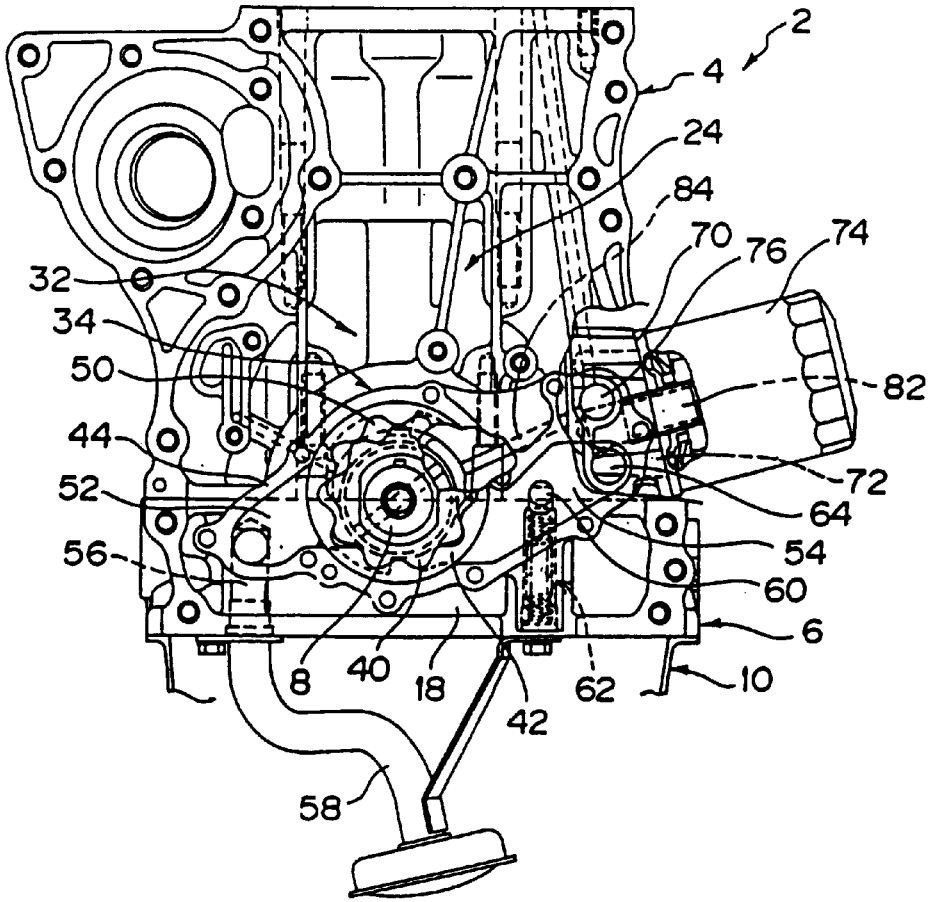
FIG. 6 is a schematic front view of the FIG. 1 engine.
Figure 7:
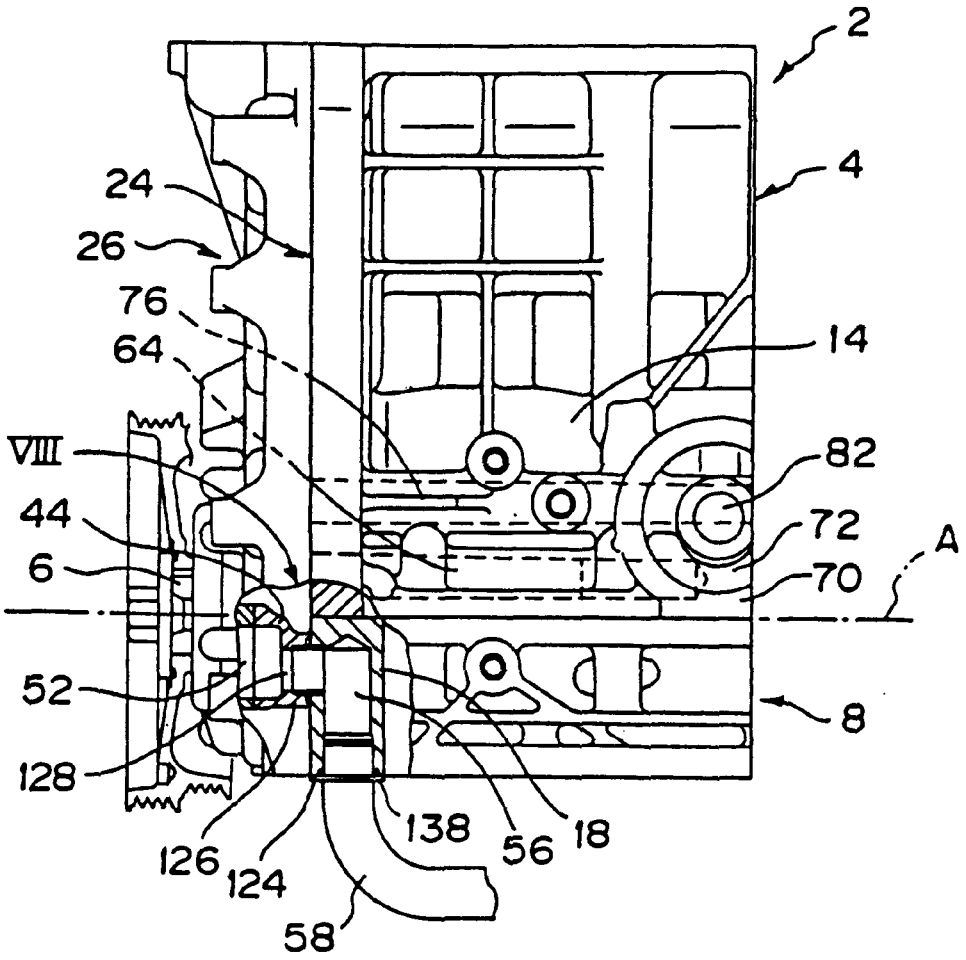
FIG. 7 is a partial side view with a portion broken away of an engine incorporating a second embodiment of the present invention.
Figure 8:
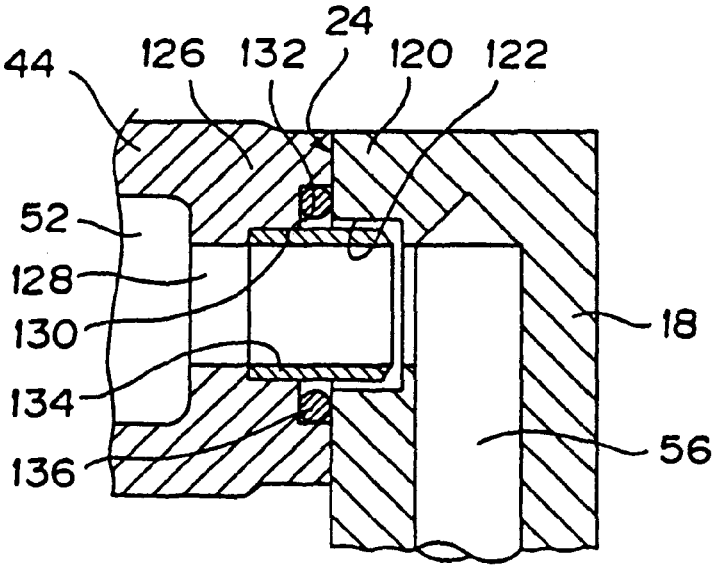
FIG. 8 is an enlarged cross-sectional showing of the engine portion designated by the arrow VIII in FIG. 7.
Figure 9:
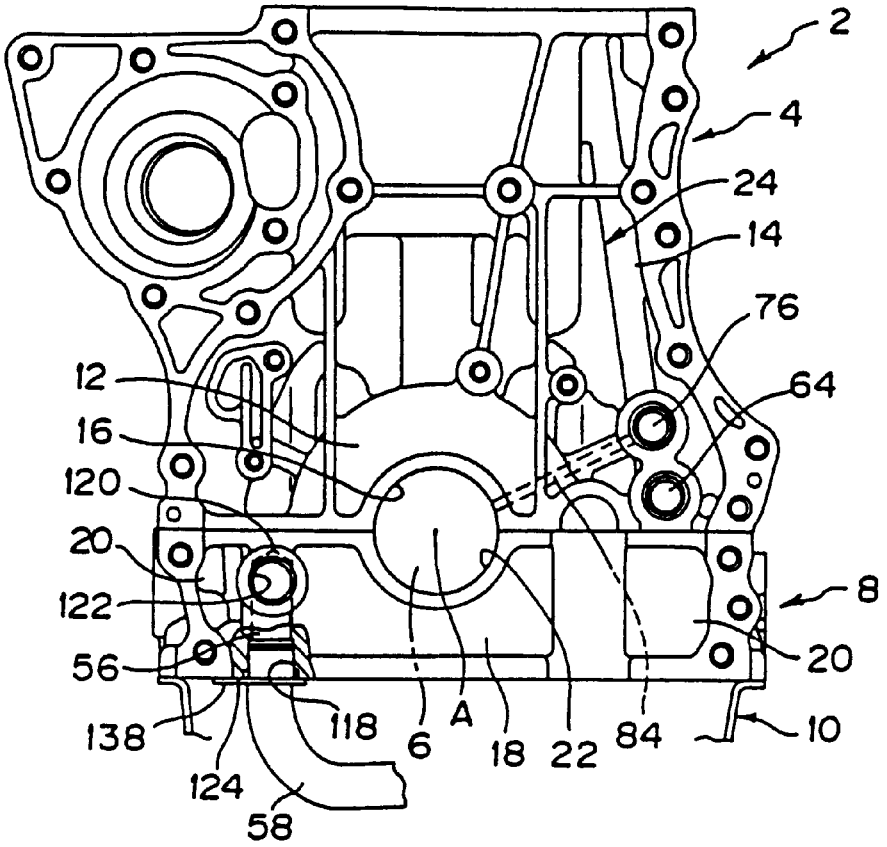
FIG. 9 is a front view of the FIG. 7 engine.
Figure 10:
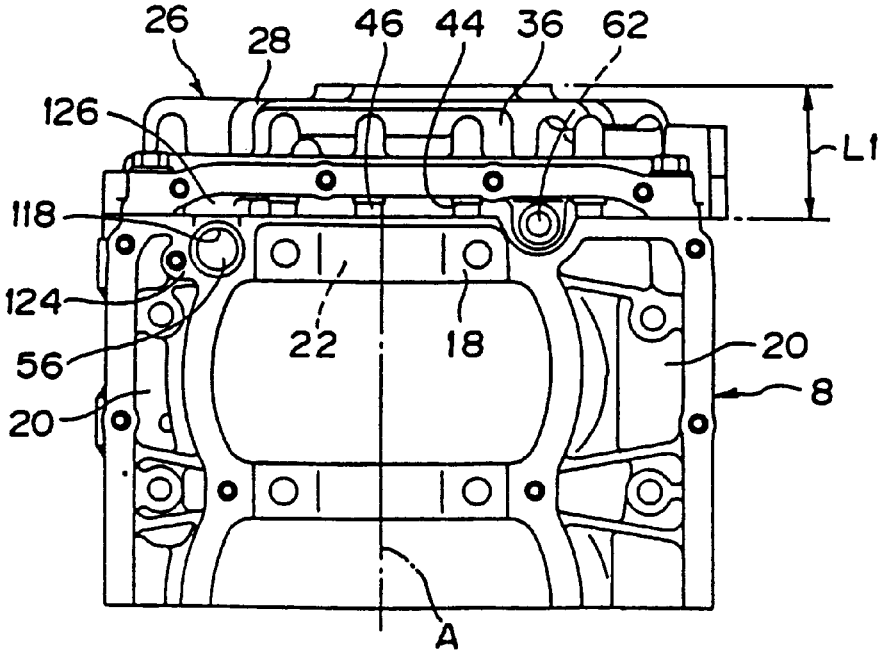
FIG. 10 is a bottom view of the FIG. 7 engine.
Figure 11:
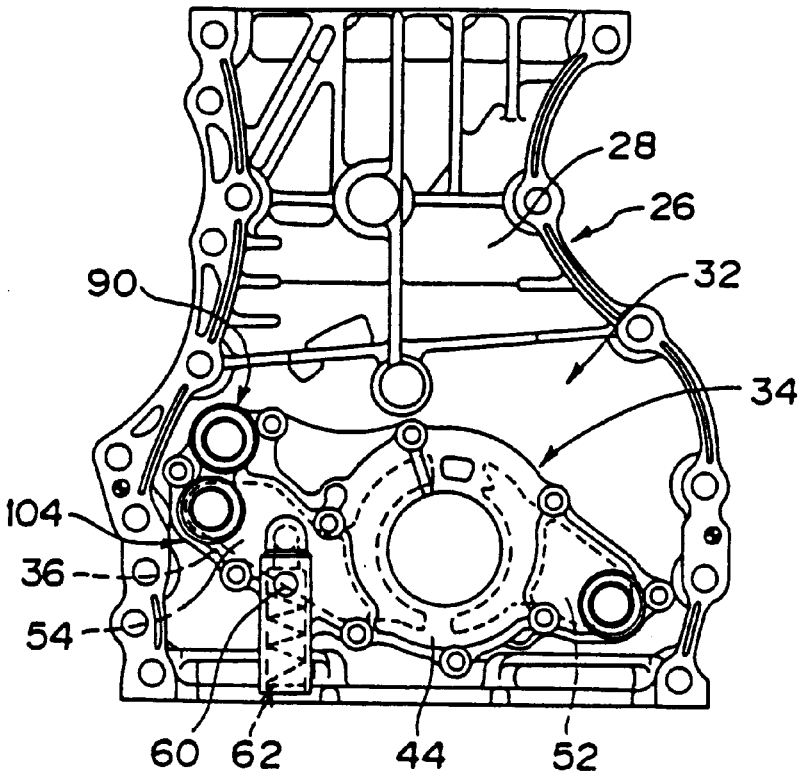
FIG. 11 is a rear view of a chain case of the FIG. 7 engine.
Figure 12:
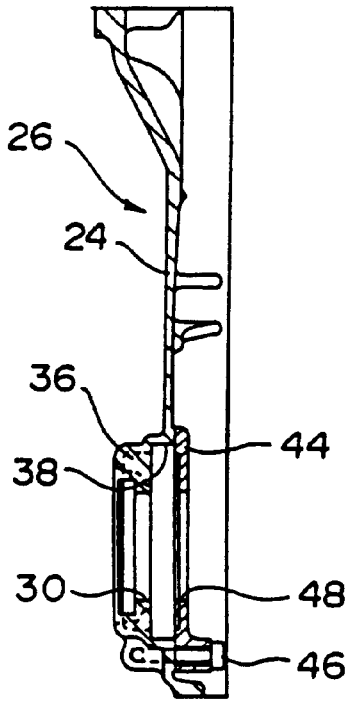
FIG. 12 is cross-sectional view of the chain case.

Referring to FIG. 5, rotor plate 44 of oil pump 34 which is attached to chain case 26, has a main sealing means 90 for sealing opening 80 of main oil pathway 76.

For sealing means 90, a main sealing boss 92 which abuts against opening boss 78 of cylinder block 4 is placed on rotor plate 44. On sealing boss 92, there is a main seal engagement hole 94 which coincides with opening 80 and has a slightly larger diameter than opening 80. Around seal engagement hole 94, there is a main seal rim 96. A main engagement cylinder 98 is pushed into seal engagement hole 94. A main O-ring 100 is attached to seal rim 96 around the engagement cylinder 98.

When rotor plate 44 which is attached to chain case 26, is being attached to cylinder block 4, engagement cylinder 98 is securely maintained at seal rim 96. Engagement cylinder 98 is pushed into block engagement hole 102 which is on opening boss 78 and which has a slightly larger radius than opening 80. O-ring 100 is pressed against opening boss 78 around block engagement hole 102. In such way opening 80 is sealed.

The opening boss 66 of secondary oil pathway 64 is sealed by secondary oil sealing means 104. As in opening 80 for the main oil pathway, secondary oil sealing means 104 has a sealing boss 106 which is in contact with secondary oil opening boss 66 of rotor plate 44. A secondary seal engagement hole 108 is created on seal boss 106. Seal engagement hole 108 communicates with discharge pathway 54. A secondary oil seal rim 110 is placed around seal engagement hole 108. A secondary oil engagement cylinder 112 is pushed into seal engagement hole 108 and a secondary oil O-ring 114 is attached to seal rim 110. Engagement cylinder 112 is pushed into secondary oil block engagement hole 116 on opening 68. O-ring 114 seals opening 68.

Operation of the first embodiment is now given.

When oil pump 34 is driven by crank shaft 6 of engine 2, oil supplying device 32 brings the oil from within oil pan 10 via oil strainer 56 and by guide pathway 56 to suction pathway 52. Oil in suction pathway 52 is suctioned into pump interior 50 and compressed. The oil is discharged into discharge pathway 54.

The discharged oil in discharge pathway 54 is adjusted to the desired pressure by relief valve 62. Excess oil is returned to oil pan 10 by way of relief pathway 60. The oil which has been adjusted to the desired pressure by relief valve 62 is supplied to main oil pathway 76 by secondary oil pathway 64 via oil filter 72. The oil is supplied to block side bearing surface 16 or to the bearing surface of cam shaft (not shown) by way of oil supply pathway 84. The oil lubricates and cools crank shaft 6, the cam shaft (not shown) and the like.

Oil supplying device 32 has a sealing means 90 on rotor plate 44 of oil pump 34 which is attached to chain case 26.

When chain case 26 is being attached to cylinder block 4, engagement cylinder 98 is pushed into seal engagement hole 94 of sealing means 90 which is on rotor plate 44. An O-ring 100 is attached to seal rim 96.

Chain case 26 pushes engagement cylinder 98 into block engagement hole 102 of opening boss 78. Chain case 26 also presses O-ring 100 against opening boss 78 which is around engagement hole 102. Chain case 26 is attached to cylinder block 4 by attachment bolts (not shown).

Opening 80 of main oil pathway 76 is sealed by O-ring 100. As in opening 80 of main oil pathway 76, when chain case 26 is being attached, opening 68 of secondary oil pathway 64 has an engagement cylinder 112 being pushed into block engagement hole 116. O-ring 114 is pressed against opening boss piece 68 for sealing.

In oil supplying device 32 of engine 2, a sealing means 90 seals, by an O-ring 100, rotor plate 44 of oil pump 34 (attached to chain case 26) to opening 80 of main oil pathway 76. In contrast to the PT plug of the prior art, this sealing will not plug inlet port 86 of oil supply pathway 84 which is created on block side bearings 12 of cylinder block 4. Also in contrast with the PT plug of the prior art, opening 80 of main oil pathway 76 can be stoppered without the area surrounding opening 80 of main oil pathway 76 becoming deformed.

As a result, in this oil supplying device 32, the sealing quality of opening 80 of main oil pathway 76 is improved, and seal failure is reduced. There is greater freedom in the placement position of oil supplying pathway 84 which is provided on block side bearings 12 of cylinder block 4. The pathway area for oil supply pathway 84 is ensured. The reliability of the flatness of the contact surface of opening boss 66, which is formed on opening 68 of secondary oil pathway 64 (which is in neighboring contact with main oil pathway 76) is improved. The sealing quality of O-ring 114 which seals opening 68 of the secondary oil pathway is improved.

Sealing means 90 need not be an O-ring 100. It also could be a gasket or a liquid gasket.

Referring to FIGS. 7–12, there is shown a second embodiment of the invention. In this second embodiment, the parts which have the same function as in the first embodiment are explained using the same numerals.

FIGS. 7–12 depict engine 2, cylinder block 4, crank shaft 6, lower case 8, oil pan 10, block side bearing members 12, block wall 14, block side bearing surface 16, a case side bearing member 18, a case linking member 20, a case side bearing surface 22, one side surface 24, chain case 26, wall 28, an insertion hole 30, and oil supplying device 32.

From FIGS. 7–10 it is seen in the second embodiment of oil supplying device 32, such has case side bearings 18 on side 24 in the crank shaft axis line A direction of lower case 8, and a guide pathway 56 which connects oil pan 10 to suction pathway 52 of oil pump 36.

Guide pathway 56, which is formed on case side bearing 18, is in the direction which intersects with crank shaft axis line A and on the other side of case side bearing surface 22. One end is connected to the inlet port 118 on the side of oil pan 10. The other end is connected to exit hole 122 of exit boss 120 on the side of rotor plate 44. Around inlet port 118 on the oil pan side of case side bearing 18, there is a strainer attachment part 124 for attaching oil strainer 58.

On rotor plate 44, a communicating seal boss 126 abuts against exit hole boss 120. Seal boss 126 coincides with exit hole 122. A communication hole 128 communicates with suction pathway 56. There is a seal engagement hole 130 which has a slightly larger diameter than the communication hole 128.

On seal boss 126 of rotor plate 44 there is a sealing rim 132 around seal engagement hole 130. Engagement cylinder 134 for communication is pushed into seal engagement hole 130. An O-ring 136 is attached to sealing rim 132 which is around the engagement cylinder 134.

When rotor plate 44 which is attached to chain case 26 is being attached to cylinder block 4, engagement cylinder 134 securely maintains O-ring 136 at sealing rim 132 and is inserted into exit hole 122 on exit hole boss 120. O-ring 136 is pressed against exit boss 120 which surrounds exit hole 122 and seals exit hole 122.

The operation of the second embodiment is explained next.

In the second embodiment of oil supplying device 32, on case side bearing 18 on lower case 8, there is a guide pathway 56 which connects oil pan 10 to suction pathway 52 of oil pump 34. On the side of oil pan 10 of guide pathway 56 of case side bearing 18, there is strainer attachment part 124 where oil strainer 58 is attached.

When chain case 26 is installed on cylinder block 4, engagement cylinder 134 is pushed into sealing engagement hole 130 on sealing boss 126 of rotor plate 44. O-ring 136 is also attached to sealing rim 132 of engagement cylinder 134.

Chain case 26 inserts engagement cylinder 134 of rotor plate 44 into exit hole 122 of exit boss part 120. Chain case 26 also presses O-ring 136 against exit hole boss 120 around exit hole 122 and is attached to cylinder block 4.

As a result, guide pathway 56 is sealed at exit hole 122 by O-ring 136. Guide pathway 56 communicates with suction pathway 52 by way of communicating hole 128. Attachment flange 138 of oil strainer 58 is attached to strainer attachment part 124 on case side bearing member 18 of lower case 8 by way of an attachment bolt (not shown).

In the oil supplying device 32 of the second embodiment, oil pump 34 is driven by crank shaft 6 of engine 2. The oil within oil pan 10 passes through oil strainer 58 and is brought to guide pathway 56 from inlet port 118 on case side bearing 18 of lower case 8. The oil goes from the exit hole 122 of guide pathway 56 through the inside of engagement cylinder 134 and is brought to suction pathway 52 through communicating hole 128. The oil in suction pathway 52 is suctioned into pump room 50 and is compressed. The oil is discharged to discharge pathway 54.

The oil which is discharged from discharge pathway 54 is adjusted to the desired pressure by relief valve 62. Excess oil is returned to oil pan 10 by relief pathway 60. The oil which has been adjusted to the desired pressure by relief valve 62 is supplied to main oil pathway 76 by secondary pathway 64 and via oil filter 74. The oil lubricates and cools crank shaft 6 or the cam shaft (not shown) or the like.

In the second embodiment of oil supplying device 32, on case side bearing 18 of lower case 8 which supports crank shaft 6, there is a guide pathway 56 which connects oil pan 10 to suction pathway 52 of oil pump 34. On the side of oil pan 10 of guide pathway 56 of side case bearing 18, there is a strainer attachment part 124 which attaches oil strainer 58.

Figure 18:
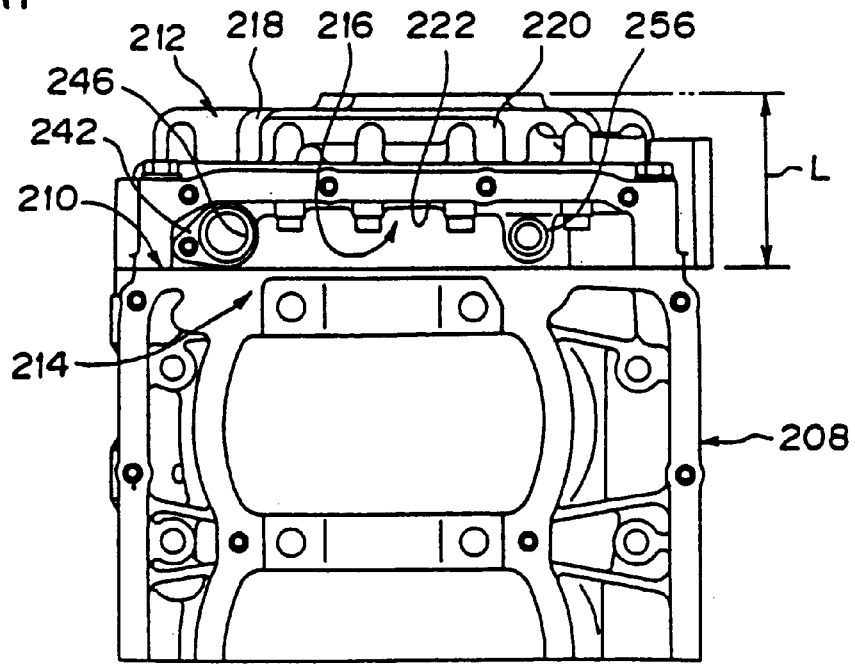
FIG. 18 is a bottom view of the prior art engine.
Figure 19:
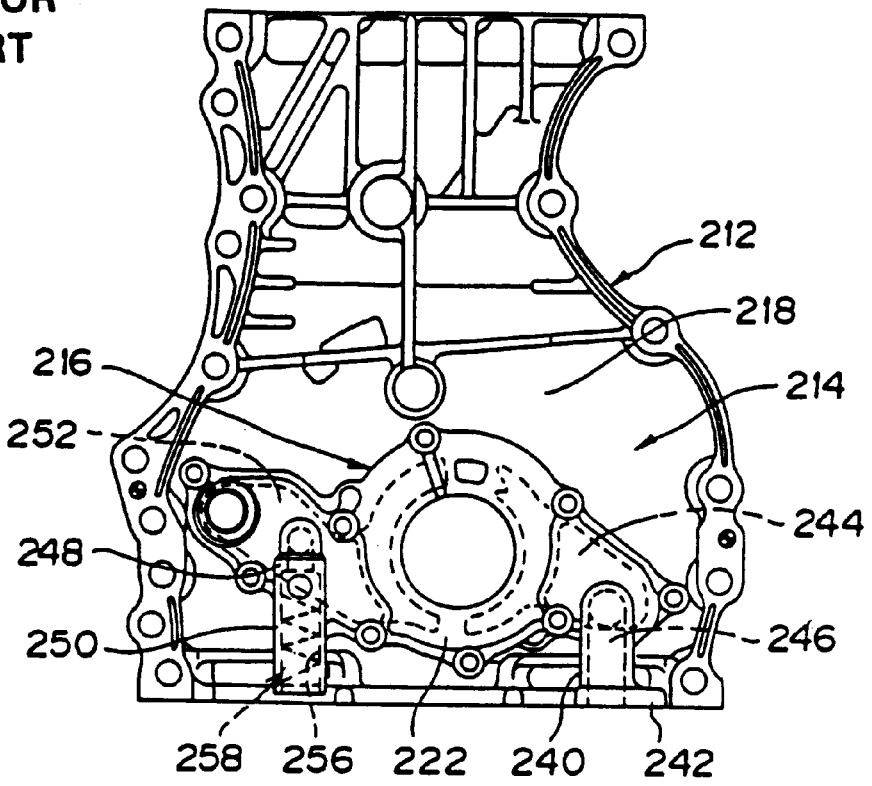
FIG. 19 is a rear view of a chain case of the prior art engine.
Figure 20:
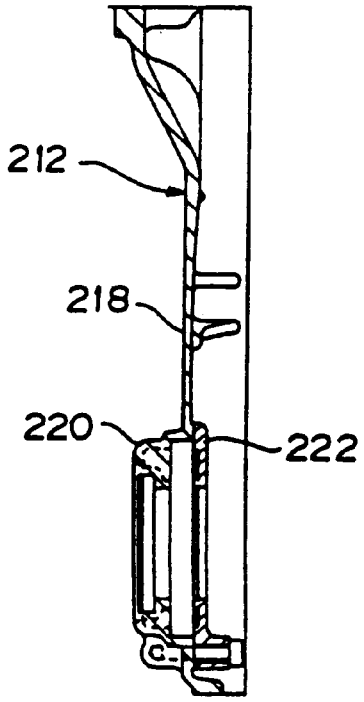
FIG. 20 is a cross-section of the chain case.

In the second embodiment of the oil supplying device 32, using case side bearing 18 of lower case 8, a guide pathway 56 which brings oil from inside oil pan 10 and a strainer attachment part 124 which attaches oil strainer 58 can be provided. In contrast to the prior art, a guide pathway formation or strainer attachment flange on rotor plate 44 does not need to project obtrusively. The length L1 by which rotor plate 44 which attaches to chain case 26 projects out in the crank shaft axis line A direction can be made shorter than projection length L in the chain case of the prior art (refer to FIG. 18) ($L1<L$).

With use of the second embodiment of oil supplying device 32, it is possible to shorten the overall length of engine 2 and also to lighten engine 2. By using the case side bearing 18 of lower case 8, dead space is used effectively.

O-ring 136 which is pressed against exit hole boss piece 120 and seals exit hole 122 can be a gasket or a liquid gasket.

Figure 13:
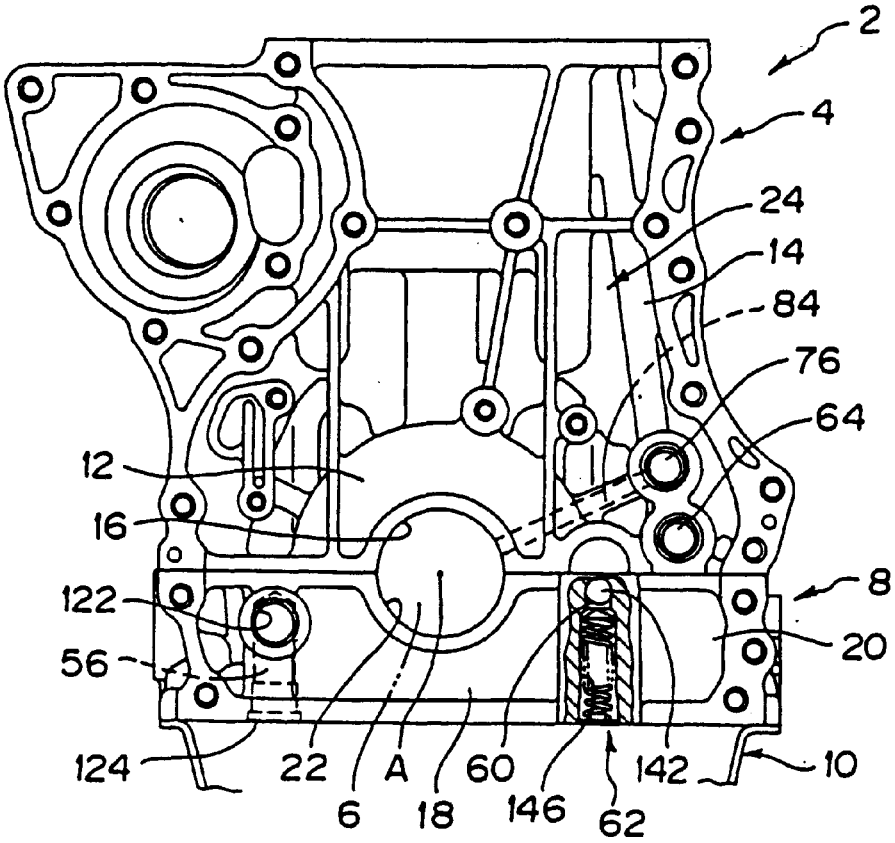
FIG. 13 is a partial front view of an engine incorporating a third embodiment of the present invention.
Figure 14:
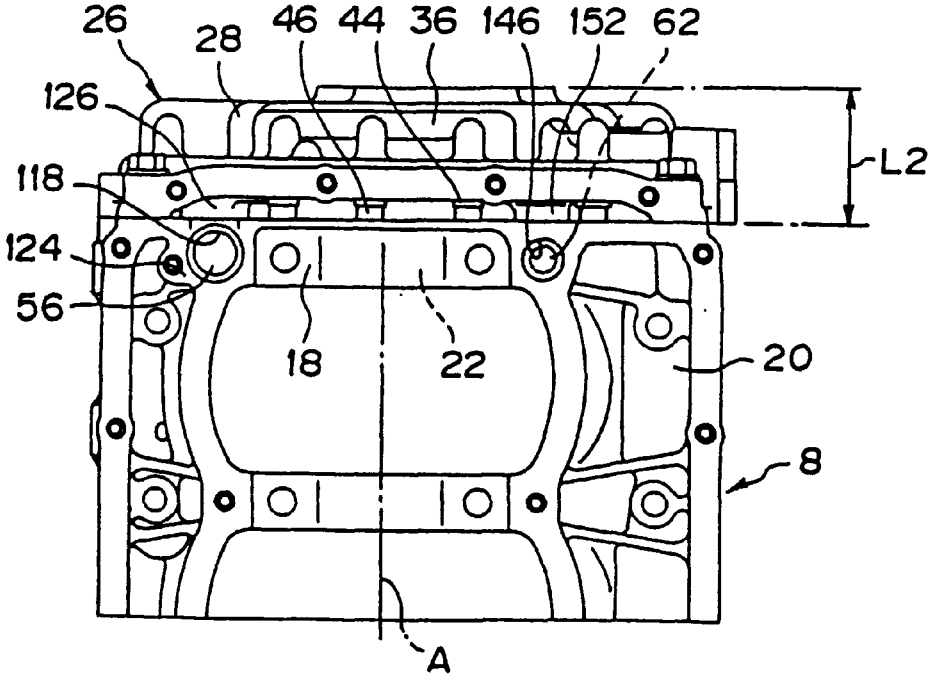
FIG. 14 is a bottom view of the FIG. 13 engine.
Figure 15:
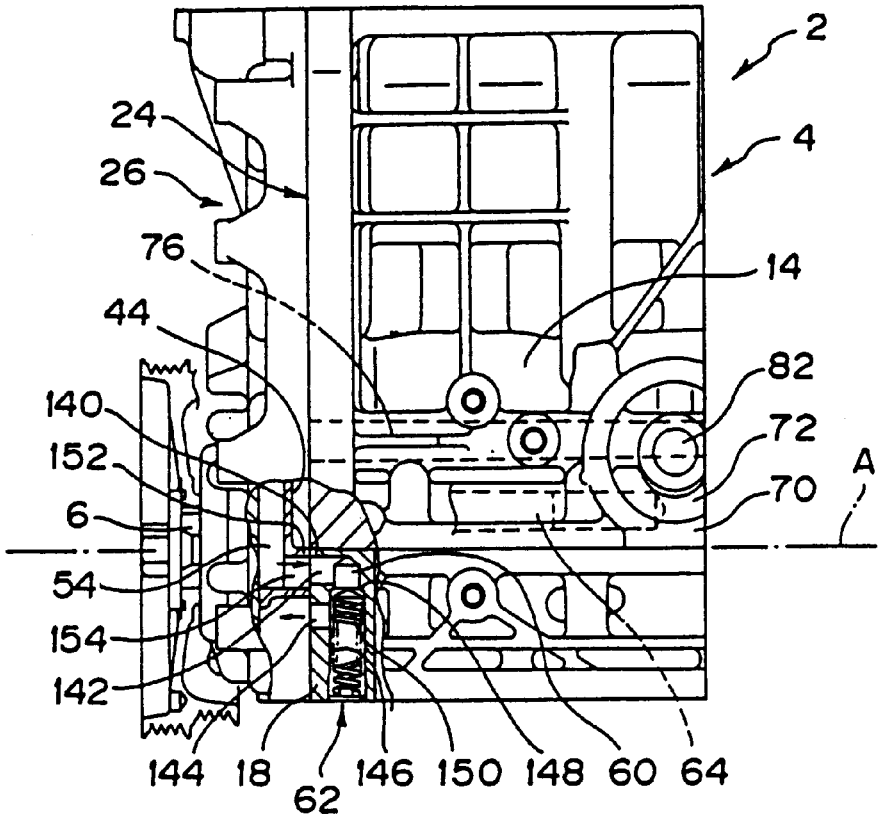
FIG. 15 is a partial side view with a portion broken away of the FIG. 13 engine.
Figure 16:
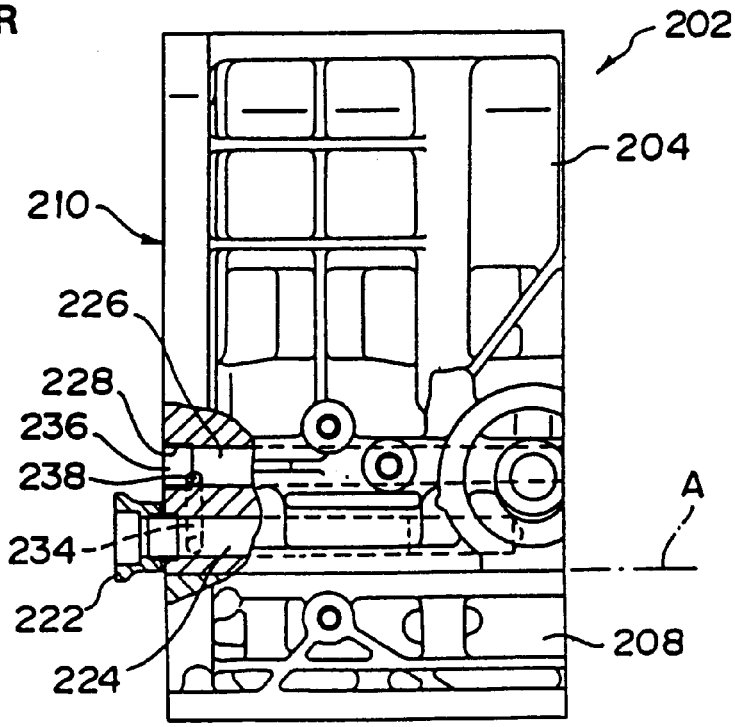
FIG. 16 is a partial side view with a portion broken away of an engine of the prior art.
Figure 17:
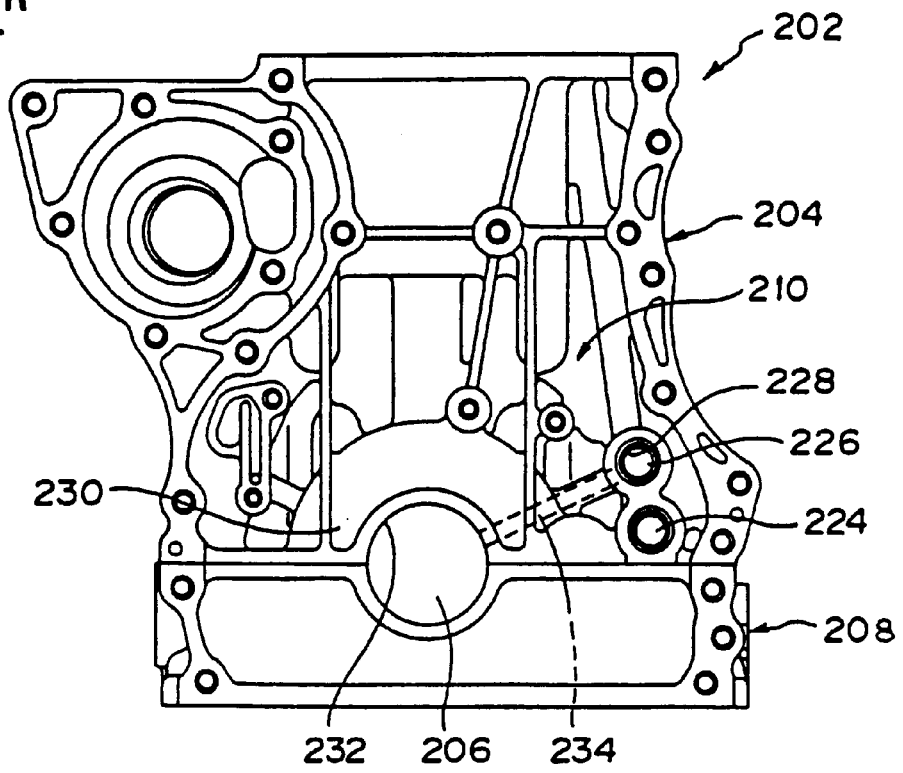
FIG. 17 is a front view of the prior art engine.

Referring now to FIGS. 13–15, a third embodiment of the invention is described and wherein any parts which have the same function as in the first and second embodiments are described with use of the same numerals.

FIGS. 13–15 show engine 2, cylinder block 4, crank shaft 6, lower case 8, oil pan 10, block side bearing 12, block wall 14, a block side bearing 16, case side bearing 18, a case linking member 20, case side bearing surface 22, one side 24, chain case 26, wall 28, insertion hole 30 and oil supplying device 32.

In the oil supplying device 32 of the third embodiment, case side bearing 18 on side 24 in the crank shaft axis line A direction of lower case 8, there is a relief pathway 60 which connects discharge pathway 54 of oil pump 34 to oil pan 10.

Relief pathway 60 of case side bearing 18 is on the other side of the direction which intersects with crank shaft axis line A opposite of guide pathway 56 with case side bearing surface 22 in between. One end of relief pathway 60 is connected to inlet port 142 of an inlet port boss which is pointed towards rotor plate 44. The other end of relief pathway 60 is connected to exit hole 144 which is pointed towards the inner side of chain case 26. Along relief pathway 60 of case side bearing 18, there is a relief valve attachment hole 146 which attaches relief valve 62.

Relief valve attachment hole 146 is placed so that it points from oil pan 10 of case side bearing 18 towards relief pathway 60. Relief valve 62 comprises a relief valve body 148 which opens and closes relief pathway 60, and a relief spring 150 which impels relief valve body towards the closed position. Relief valve 62 is attached to relief valve attachment hole 146 from the side of oil pan 10.

On rotor plate 44, there is a rotor boss 152 which abuts against inlet port boss 140 of case side bearing 18. On rotor boss 152, there is a communication hole 154 which connects discharge pathway 54 to inlet port 142.

Operation of the third embodiment is described now.

In the third embodiment of oil supplying device 32, a relief pathway 60 which connects discharge pathway 54 of oil pump 34 and oil pan 10 is provided on case side bearing 18 of lower case 8. Along relief pathway 60 of case side bearing 18, there is provided a relief valve attachment hole 146 to which relief valve 62 attaches. On one end of relief pathway 60, there is inlet port 142 which points toward the rotor plate 44 side. On the other end of relief pathway 60, there is an exit hole 144 which points towards the inside of chain case 26.

When attaching chain case 26 to cylinder block 4, rotor boss 152 of rotor plate 44 abuts against inlet boss 140 on lower case 8. Communication hole 154 is made to coincide with and is attached to inlet port 142.

Relief pathway 60 communicates with discharge pathway 54 by inlet hole 142 via communication hole 154.

In the third embodiment of oil supplying device 32, oil pump 34 is driven by crank shaft 6 of engine 2. The oil within oil pan 10 is lead in to guide pathway 56 on case side bearing 18 of lower case 8 and through oil strainer 58. The oil in guide pathway 56 is lead to suction pathway 52. The oil in suction pathway 52 is suctioned into pump interior 50 and is compressed. The oil is discharged into discharge pathway 54.

The oil discharged from discharge pathway 54 is brought to relief pathway 60 from communication hole 154 via inlet port 142. The oil is adjusted to the desired pressure by relief valve 62. Excess oil is discharged towards the inner side of chain case 26 by the exit hole 144 on relief pathway 60 of case side bearing 18 of lower case 8, and the oil is returned to oil pan 10.

The oil, which has been adjusted to the desired pressure by relief valve 62, is supplied to main oil pathway 76 by way of secondary pathway 64 and through oil filter 74. The oil lubricates and cools crank shaft 6 and the cam shaft (not shown) or the like.

The third embodiment of oil supplying device 32 has a relief pathway 60 which connects discharge pathway 54 of oil pump 34 and oil pan 10 on case side bearing 18 of lower case 8 which supports crank shaft 6. Along relief pathway 60 of case side bearing 18, there is a relief valve attachment hole 146 which attaches relief valve 62. Exit hole 144 of relief pathway 60 is pointed toward the inside of chain case 26.

In the third embodiment of oil supplying device 32, using case side bearing 18 of lower case 8, a relief pathway 60 for relieving oil discharged from oil pump 34 and a relief valve attachment hole 146 which attaches relief valve 62 are provided. In contrast to the prior art, a relief pathway formation or a relief valve attachment piece does not project out from rotor plate 44. The projection length L2 from the chain case 26 which is attached to rotor plate 44 in the crank shaft axis line A direction can be made shorter than the projection distance L from the chain case of the prior art (L2<L). By providing the guide pathway 56 and strainer attachment piece 124 inside case side bearing 18 of lower case 8, the projection length L2 is made shorter than projection length L1 of the second embodiment.

As a result, use of the third embodiment of oil supplying device 32 can shorten the overall length of engine more than the second embodiment and the engine 2 lightened more so. Because case side bearing 18 of lower case 8 is being used, dead space is effectively used. Because the exit hole 144 of relief pathway 60 is pointing towards the inside of chain case 26, aeration of the oil due to crank shaft 6 is reduced. The performance of the oil in lubricating and cooling can be improved.

The engine oil supplying device of the invention does not plug up the entrance hole of the oil supply pathway on the block side bearing of the cylinder block as in the PT plug of the prior art. Furthermore, the area around the opening of the main oil pathway does not become deformed, and the opening of the main oil pathway is not blocked.

As a result, the oil supplying device improves the sealing quality of the opening of the main oil pathway. Seal failure is reduced and there is greater freedom in positioning of the oil supply pathway on the block side bearing of the cylinder block. Space for the oil supply pathway is obtained. The sealing quality of the opening for the secondary oil pathway which is adjacent to the main oil pathway is improved.

In the oil supplying device of the present invention, using the case side bearing of the lower case, a guide pathway where the oil from within the oil pan is drawn to the oil pump and a strainer attachment piece where an oil strainer is attached is provided. In contrast to the prior art, there is no guide pathway formation on the rotor plate or a strainer attachment flange which projects out obtrusively. The projection length out in the crank shaft axial direction from the chain case where the rotor plate is attached can be shortened.

As a result, with this oil supplying device, the overall length of the engine can be shortened and the engine can be lightened. By utilizing the case side bearing of the lower case, dead space can be effectively utilized.

Further, the engine oil supplying device of the invention utilizes the case side bearing of the lower case. The present invention has a relief pathway which relieves oil discharged from the oil pump. There is a relief valve attachment hole where the relief valve can be attached. The relief pathway formation or relief attachment piece does not need to project out from the rotor plate as in the prior art. The projection distance of the chain case to which the rotor plate is attached can be shortened in the crank shaft axis line direction.

As a result, this oil supplying device can shorten the overall the length of the engine and lighten the engine. By utilizing the case side bearing of the lower case, dead space is effectively utilized. Furthermore, by pointing the exit hole of the relief pathway towards the inner side of the chain case, the aeration of the oil by the crank shaft is lowered. The performance in lubricating and cooling by the oil is improved.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An oil supplying device of an engine, wherein a lower case which supports a crank shaft is attached to a cylinder block of an engine, an oil pan is attached to said lower case, a chain case is attached to one end side surface of a crank shaft axis line of said engine, an oil pump driven by the crank shaft is carried on an inner side of said chain case, said oil pump suctioning oil from within said oil pan, one end of a main oil pathway has an opening at said one end side surface on the crank shaft axis line of said cylinder block, said main oil pathway being directed towards an opposite end side on the crank shaft axis line, oil discharged from said oil pump being supplied to said main oil pathway, an oil pump rotor plate attached to said chain case, said rotor plate carrying a seal means for sealing said opening of said main oil pathway, on case bearings of said lower case which supports said crank shaft, there being a lead-in pathway which connects said oil pan to a suction pathway of said oil pump, on an end of said lead-in pathway proximal said oil pan, there being a stainer attachment part for attaching an oil strainer, on said case side bearings of said lower case which supports said crank shaft, there further being a relief pathway which connects a discharge pathway of said oil pump to said oil pan, and along said relief pathway of said case side bearings, a relief valve attachment hole is provided for attaching an oil pressure relief valve thereto.

2. An oil supplying device of an engine as described in claim 1 in which the seal means includes a sealing boss carried on the rotor plate and having a main seal rim receivable in said one end opening, and a seal member exteriorly encircling the seal rim and interposed between said one end side surface and a surface of the rotor plate juxtaposed therewith.

3. An oil supplying device of an engines, wherein a lower case which supports a crank shaft is attached to a cylinder block of an engine, an oil pan is attached to said lower case, a chain case is attached to one end side surface of a crank shaft axis line of said engine, an oil pump driven by the crank shaft is carried on an inner side of said chain case, said oil pump suctioning oil from within said oil pan, one end of a main oil pathway has an opening at said one end side surface on the crank shaft axis line of said cylinder block, said main oil pathway being directed towards an opposite end side on the crank shaft axis line, oil discharged from said oil pump being supplied to said main oil pathway, an oil pump rotor plate attached to said chain case, said rotor plate carrying a seal means for sealing said opening of said main oil pathway, the seal means includes a sealing boss carried on the rotor plate and having a main seal rim receivable in said one end opening, and a seal member exteriorly encircling the seal rim and interposed between said one end surface and a surface of the rotor plate juxtaposed therewith, and a secondary oil pathway having an opening at said one end side surface on the crank shaft axis line of said cylinder block, said secondary oil pathway communicating pump oil flow to the main oil pathway, said rotor plate carrying another seal means for sealing said one end opening of said secondary oil pathway, said other seal means including another sealing boss carried on the rotor plate and having a seal rim receivable in the secondary oil pathway said one end opening, and another seal member exteriorly encircling said other seal rim and interposed between said one end side surface and a surface of the rotor plate juxtaposed therewith.

4. An oil supplying device as described in claim 3 in which the first-mentioned seal member and said other seal member each are one of an O-ring and a gasket.

* * * * *